US008806971B2

(12) United States Patent
Yamauchi et al.

(10) Patent No.: US 8,806,971 B2
(45) Date of Patent: Aug. 19, 2014

(54) STARTER

(75) Inventors: Hayato Yamauchi, Tokyo (JP); Yoshihiro Nishikawa, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 243 days.

(21) Appl. No.: 12/913,319

(22) Filed: Oct. 27, 2010

(65) Prior Publication Data

US 2011/0259146 A1 Oct. 27, 2011

(30) Foreign Application Priority Data

Apr. 27, 2010 (JP) ..... 2010-102085

(51) Int. Cl.
*F02N 11/14* (2006.01)

(52) U.S. Cl.
USPC ..... 74/7 C

(58) Field of Classification Search
USPC ..... 74/7 C, 6–9, 7 A, 7 B, 141.5, 156; 192/42, 43.1, 53.362, 70.29, 70.3, 99 A, 192/99 R, 110 B; 123/179.1–184.1
See application file for complete search history.

(56) References Cited

U.S. PATENT DOCUMENTS

| | | | | | |
|---|---|---|---|---|---|
| 1,480,021 | A * | 1/1924 | Smith | 192/69.9 |
| 2,554,445 | A * | 5/1951 | Miller | 74/6 |
| 2,960,879 | A * | 11/1960 | Lafitte | 74/6 |
| 3,283,595 | A * | 11/1966 | Inagaki | 74/7 R |
| 3,299,719 | A * | 1/1967 | Toulier | 74/7 R |
| 3,579,809 | A | 5/1971 | Wolf et al. | |
| 3,603,803 | A * | 9/1971 | Bowcott | 290/38 A |
| 4,116,077 | A * | 9/1978 | Mazzorana | 74/7 A |
| 4,149,424 | A * | 4/1979 | Bowcott | 74/7 A |
| 4,579,010 | A * | 4/1986 | Colvin et al. | 74/7 A |
| 5,341,697 | A * | 8/1994 | Isozumi | 74/7 A |
| 5,367,913 | A * | 11/1994 | Yumiyama et al. | 74/7 A |
| 5,777,393 | A * | 7/1998 | Katoh et al. | 290/48 |
| 6,202,497 | B1 * | 3/2001 | Kuragaki et al. | 74/7 A |
| 7,980,150 | B2 * | 7/2011 | Hasegawa et al. | 74/7 E |
| 2006/0266137 | A1 * | 11/2006 | Usami et al. | 74/6 |
| 2007/0068288 | A1 * | 3/2007 | Hasegawa et al. | 74/7 A |
| 2007/0137325 | A1 * | 6/2007 | Murase et al. | 74/7 E |

(Continued)

FOREIGN PATENT DOCUMENTS

| | | |
|---|---|---|
| DE | 916368 | 8/1954 |
| JP | Hei 1-131873 U | 9/1989 |
| JP | Hei 6-66234 A | 3/1994 |
| JP | 2006-161724 A | 6/2006 |

(Continued)

OTHER PUBLICATIONS

German Office Action issued Jul. 11, 2012, which corresponds to Patent Application No. 10 2010 040 884.0.

*Primary Examiner* — Troy Chambers
*Assistant Examiner* — Valentin Craciun
(74) *Attorney, Agent, or Firm* — Sughrue Mion, PLLC

(57) ABSTRACT

A motor; an electromagnetic switch which; a clutch; and a shift lever which is configured by a pair of lever bodies that are arranged so that one side is engaged with a plunger and the other side is engaged with the clutch, and are provided. A passing through hole is formed at each end portion on the other side of the lever bodies; and an annular plate, which is arranged at an engaging portion of the clutch and on the inside of the other side of the lever bodies and has a convex shaped engaging portion to be passed through the passing through hole, is provided.

13 Claims, 4 Drawing Sheets

(56) References Cited

U.S. PATENT DOCUMENTS

| | | | | |
|---|---|---|---|---|
| 2008/0098850 | A1* | 5/2008 | Hasegawa et al. | 74/7 E |
| 2008/0168861 | A1* | 7/2008 | Teixeira et al. | 74/7 R |
| 2009/0133531 | A1* | 5/2009 | Ono et al. | 74/7 C |

FOREIGN PATENT DOCUMENTS

| | | | |
|---|---|---|---|
| JP | 2007-085317 | A | 4/2007 |
| JP | 4178214 | B2 | 9/2008 |
| JP | 4375314 | B2 | 9/2009 |

* cited by examiner

STARTER

BACKGROUND OF THE INVENTION

1. Field of the Invention

The present invention relates to a starter in which a shift lever pivots in a seesaw motion in conjunction with reciprocation of a plunger coupled to an electromagnetic switch and a pinion gear is meshed with or removed from a ring gear.

2. Description of the Related Art

A starter equipped with a conventional DC (direct current) motor is composed of, for example, as shown in FIG. 7 and FIG. 8, an electromagnetic switch 2 which is for supplying current from a battery to a motor 1, the motor 1 which generates torque, a power transmission mechanism portion 4 which transmits the torque of the motor 1, and a clutch 5 which is for transmitting the torque to a ring gear 19; and the starter starts up an engine via a ring gear 19.

The starter includes: a shift lever 7 in which a fulcrum pin 20 that engages a plunger 9 coupled to the electromagnetic switch 2 with a clutch 5 that constitutes an output portion to the engine, is supported by a holder 23; and a clutch outer 21 that is an engaging portion between the clutch 5 and the shift lever 7 which moves the clutch 5 and a pinion 18 attached to an end portion of the clutch 5 in an axial direction by an axial motion of the plunger 9.

The shift lever 7 is composed of a pair of lever bodies 7*a* and 7*b*; and a passing through hole 7*c* which enables to pivot is provided on each one end side of the pair of lever bodies 7*a* and 7*b* of the shift lever 7. Then, a convex portion 22*a* of a shift piece 22 is passed through and attached to each of the passing through holes 7*c*. (For example, see Japanese Unexamined Patent Publication No. 2006-161724.)

Furthermore, a starter equipped with a conventional DC motor is composed of a resin lever (shift lever) and a resin annular plate (lever ring). The annular plate (lever ring) is formed with a groove on the side where a clutch (clutch shaft) is pushed out, and a plurality of washers are provided between a portion to be pushed out (stop ring) and the annular plate (lever ring). (For example, see Japanese Examined Patent Publication No. 4375314.)

In addition, a starter equipped with a conventional DC motor includes plate convex portions that are different on both sides, the plate convex portions being inserted and attached to hole portions of iron levers that are different on both sides. (For example, see Japanese Examined Patent Publication No. 4178214.)

In the starter equipped with the conventional DC motor, a portion where the clutch outer 21 is pushed and pressed is configured by substantially rectangular shift pieces 22 that are different on both sides. In recent years, further longer operating life is required; however, there generates a limit to abrasion resistance of the shift piece 22. Furthermore, there is a problem in that abrasion progresses; accordingly, a crack at a corner portion of the shift piece 22 is generated and it causes an obstacle to a movement of the clutch outer 21 and the shift piece 22.

Further, in the starter equipped with the conventional DC motor, a portion where the clutch outer 21 is pushed and pressed is formed to be an annular plate and, in assembling, the lever needs to be made of resin that is deformable in horizontal directions; and thus, it causes deformation and fracture of the lever and it becomes an obstacle to durability. In addition, the groove of the annular plate is formed only on the pushing out side; and therefore, abrasion is generated on the clutch return side. The annular plate has directionality and therefore there is a problem in assembling performance to the clutch.

SUMMARY OF THE INVENTION

The present invention has been made to solve the problem described above, and an object of the present invention is to achieve inexpensive price, an improvement in abrasion resistance of a plate, and an improvement in durability and strength of a lever. Another object of the present invention is to achieve an improvement in assembling performance of an annular plate and a lever.

According to the present invention, there is provided a starter which includes: a motor; an electromagnetic switch which switches energization to the motor; a clutch which transmits rotational force from the motor to a ring gear via a pinion and is configured to be capable of reciprocating; and a shift lever which is configured by a pair of lever bodies that are arranged so that one side is engaged with a plunger coupled to the electromagnetic switch and the other side is engaged with the clutch by striding over the clutch, and are driven by a movement of the plunger to reciprocate the clutch. In the starter, a passing through hole is formed at each end portion on the other side of the lever bodies of the shift lever; and an annular plate is provided, the annular plate being arranged at an engaging portion of the clutch and on the inside of the other side of the lever bodies of the shift lever and having a convex shaped engaging portion to be passed through the passing through hole formed at each end portion on the other side of the lever bodies of the shift lever.

Furthermore, according to the present invention, there is provided a starter which includes: a motor; an electromagnetic switch which switches energization to the motor; a clutch which transmits rotational force from the motor to a ring gear via a pinion and is configured to be capable of reciprocating; and a shift lever which is configured by a pair of lever bodies that are arranged so that one side is engaged with a plunger coupled to the electromagnetic switch and the other side is engaged with the clutch by striding over the clutch, and are driven by a movement of the plunger to reciprocate the clutch. In the starter, a first engaging portion is formed on one of the pair of lever bodies of the shift lever; and a second latching portion which is engaged with the first engaging portion is formed on the other of the pair of lever bodies.

According to a starter of the present invention, there can be obtained a starter which can achieve inexpensive price, an improvement in abrasion resistance of a plate, and an improvement in durability and strength of a shift lever; and which can further achieve an improvement in assembling performance of an annular plate and a shift lever.

The foregoing and other objects, features, aspects and advantages of the present invention will become more apparent from the following detailed description of the present invention when taken in conjunction with the accompanying drawings.

DETAILED DESCRIPTION OF THE INVENTION

Embodiment 1

Figure 1:
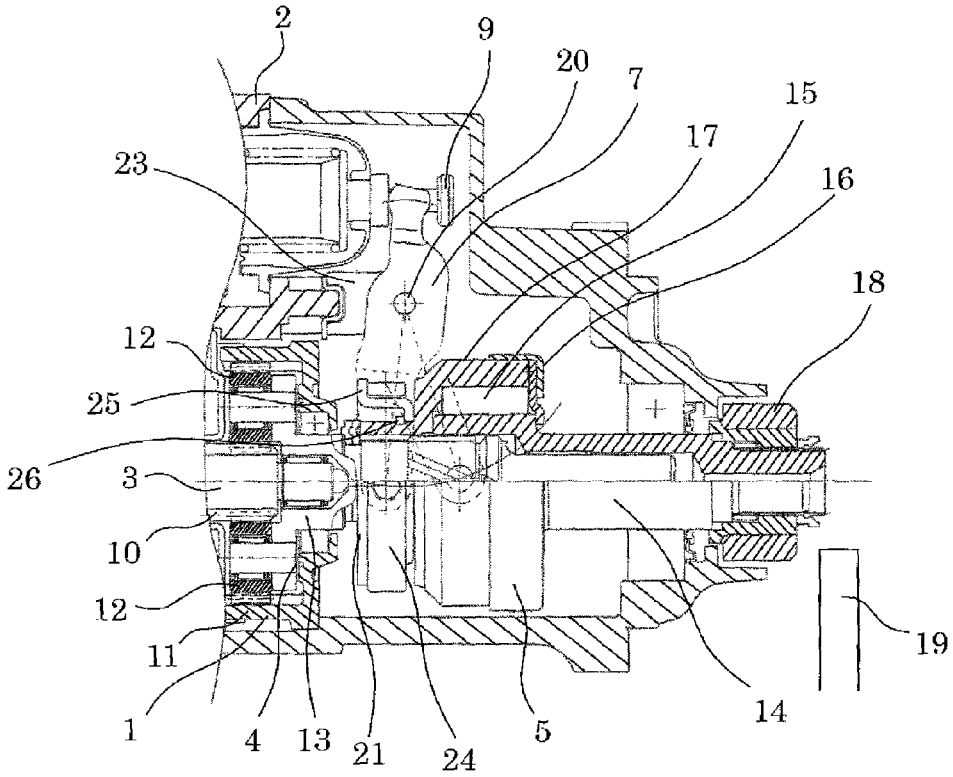
FIG. 1 is a sectional view showing a starter according to Embodiment 1 of the present invention.
Figure 2:
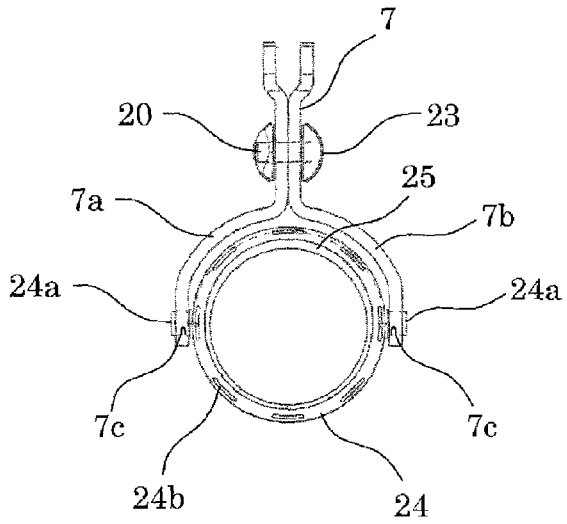
FIG. 2 is a front view showing a shift lever portion in the starter according to Embodiment 1 of the present invention.
Figure 3:
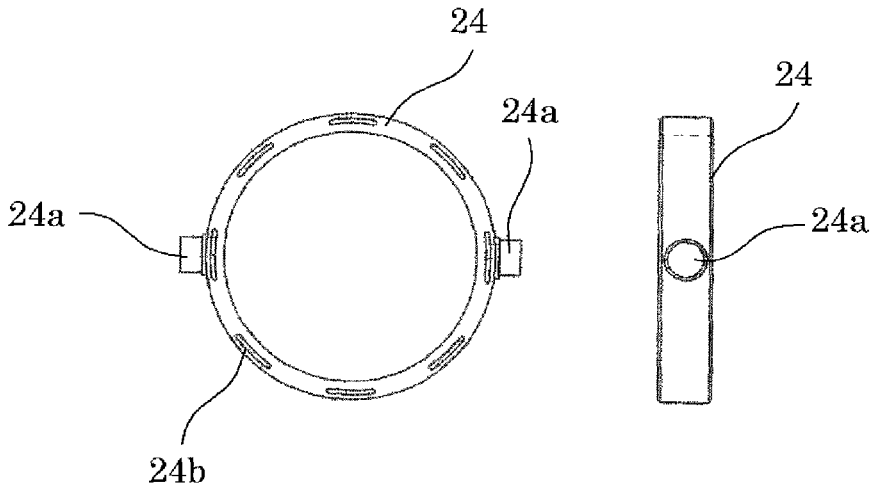
FIG. 3 is a view showing an annular plate in the starter according to Embodiment 1 of the present invention.

Hereinafter, Embodiment 1 of the present invention will be described on the basis of FIG. 1 to FIG. 3. In each of the drawings, identical or equivalent members and portions will be described with the same reference numerals. FIG. 1 is a sectional view showing a starter according to Embodiment 1 of the present invention. FIG. 2 is a front view showing a shift lever portion in the starter according to Embodiment 1 of the present invention. FIG. 3 is a view showing an annular plate in the starter according to Embodiment 1 of the present invention.

The starter in Embodiment 1 includes a motor 1, an electromagnetic switch 2 which switches energization to the motor 1, a power transmission mechanism portion 4 to which rotational power of a motor shaft 3 is transmitted, a clutch 5 coupled to the power transmission mechanism portion 4, a shift lever 7 which is provided across between the clutch 5 and the electromagnetic switch 2 and reciprocates the clutch 5, and a pinion 18 axially slidably spline-connected to the end of a pinion shaft 14 of the clutch 5.

In the electromagnetic switch 2, a plunger 9 coupled to a movable core (not shown in the drawing) of the electromagnetic switch 2 protrudes. The plunger 9 is energized and excited by a coil (not shown in the drawing) of the electromagnetic switch 2; and accordingly, the plunger 9 is operatively connected with the movable core that is sucked to the fixed core (not shown in the drawing) side.

The power transmission mechanism portion 4 is provided with a sun gear 10 on the motor shaft 3. An internal gear 11 is provided surrounding the sun gear 10. A plurality of planet gears 12 coming in internal contact with the sun gear 10 and coming in external contact with the internal gear 11 are provided at circumferentially equally spaced intervals between the sun gear 10 and the internal gear 11. One end portion of a planet gear axis 13 is rotatably passed through a central axis of each of the planet gears 12. The other end portion of the planet gear axis 13 is extendedly provided along a central axis line of the pinion shaft 14 and is spline-connected to a wall surface of the pinion shaft 14.

In the clutch 5, a plurality of clutch rollers 15 are provided at circumferentially spaced intervals on an outer circumference of the pinion shaft 14. Axial one end surfaces of the respective clutch rollers 15 are covered with a clutch cover 16 and circumferential surfaces of the respective clutch rollers 15 are covered with a clutch housing 17.

The shift lever 7 pivotably supported by a fulcrum pin 20 inserted to a holder 23 is engaged with the plunger 9 at one side. Furthermore, the shift lever 7 is configured by a pair of lever bodies 7*a* and 7*b* of iron plate-like shaped members formed in mirror symmetry to each other, and the other side of the shift lever 7 is separated in two branches that are arranged by striding over the clutch 5. A pair of passing through holes 7*c* are formed at end portions on the other side of the shift lever 7 in face-to-face relation to each other.

An annular plate 24 provided with convex shaped engaging portions 24*a* is arranged at a clutch outer 21 that is an engaging portion of the clutch 5 and on the inside of the other side of the lever bodies 7*a* and 7*b* of the shift lever 7, the convex shaped engaging portions 24*a* being passed through the passing through holes 7*c* respectively formed at the end portions on the other side of the lever bodies 7*a* and 7*b* of the shift lever 7. Incidentally, a washer 25 retained by a snap ring 26 is provided on the clutch outer 21. Furthermore, the annular plate 24 is formed with, for example, a plurality of grooves 24*b* in a circumferential direction on a portion where the washer 25 and the clutch outer 21 are pushed. Alternatively, in place of the grooves 24*b*, a plurality of through holes may be provided. Further, a case where the annular plate 24 is made of, for example, a resin member is shown.

Next, the operation of the thus configured starter in Embodiment 1 will be described. When a key switch (not shown in the drawing) is closed, the coil is energized and excited and the movable core is sucked to the fixed core side; and accordingly, the plunger 9 moves to the left side in FIG. 1. With the movement of the plunger 9, the shift lever 7 pivots in a seesaw motion centering on the fulcrum pin 20 and the shift lever 7 pivots in a counterclockwise direction. In conjunction with the pivoted movement in the counterclockwise direction of the shift lever 7, the annular plate 24 in which the convex shaped engaging portions 24*a* are passed through the passing through holes 7*c* respectively provided at the end portions on the other side of the lever bodies 7*a* and 7*b* of the shift lever 7 moves to the right side in FIG. 1. By the movement of the annular plate 24, the clutch 5 is pushed out to the right side in FIG. 1 and thus the pinion 18 is meshed with a ring gear 19.

On this occasion, the electromagnetic switch 2 is activated and the motor 1 is driven to rotate the motor shaft 3. With the rotation of the motor shaft 3, the planet gears 12 move centering on the sun gear 10 while rotating on their axes. With the revolution of the planet gears 12, the planet gear axes 13, the pinion shaft 14, and the pinion 18 are rotated to rotate the ring gear 19 engaged with the pinion 18 and an internal combustion engine is started up.

After that, when the key switch is opened, energization of the coil is turned off, the movable core is separated from the fixed core, the plunger 9 protrudes to the right side in FIG. 1, the shift lever 7 pivots in a seesaw motion centering on the fulcrum pin 20, and the shift lever 7 pivots in clockwise direction. In conjunction with the pivoted movement in clockwise direction of the shift lever 7, the annular plate 24 in which the convex shaped engaging portions 24*a* are passed through the passing through holes 7*c* respectively provided at the end portions on the other side of the lever bodies 7*a* and 7*b* of the shift lever 7 moves to the left side in FIG. 1. By the movement of the annular plate 24, the clutch 5 and the pinion 18 move to the left in FIG. 1 in a direction apart from the ring gear 19 and thus the engagement between the pinion 18 and the ring gear 19 is released.

In the starter according to Embodiment 1 of the above configuration, a structure is such that the convex shaped engaging portions 24*a* of the annular plate 24 made of the resin member are inserted through the passing through holes 7*c* respectively provided at the end portions on the other side of the lever bodies 7*a* and 7*b* of the shift lever 7 to assemble the respective lever body 7*a* and lever body 7*b* made of iron plate-like shaped member; and then, the fulcrum pin 20 is inserted to the holder 23 of the fulcrum portion which supports the shift lever 7 to fix and assemble. Accordingly, it becomes possible to achieve an improvement in durability of the annular plate 24 and to assemble by the iron shift lever 7 and thus strength can be secured.

Furthermore, the annular plate 24 is formed with the grooves 24*b* on the portion where the washer 25 and the clutch outer 21 are pushed. The groove 24*b* serves as a trap for grease to be applied and abrasion resistance is improved. Incidentally, the groove 24*b* may be formed by a through hole and the same effects can be exhibited.

In addition, the annular plate 24 is configured to be the same shape in shapes of the top and bottom and front and back; accordingly, directionality is not present during assembling to the clutch outer 21 and during assembling of the lever body 7*a* and the lever body 7*b* of the shift lever 7 and thus assembling performance is improved.

Embodiment 2

Figure 4:
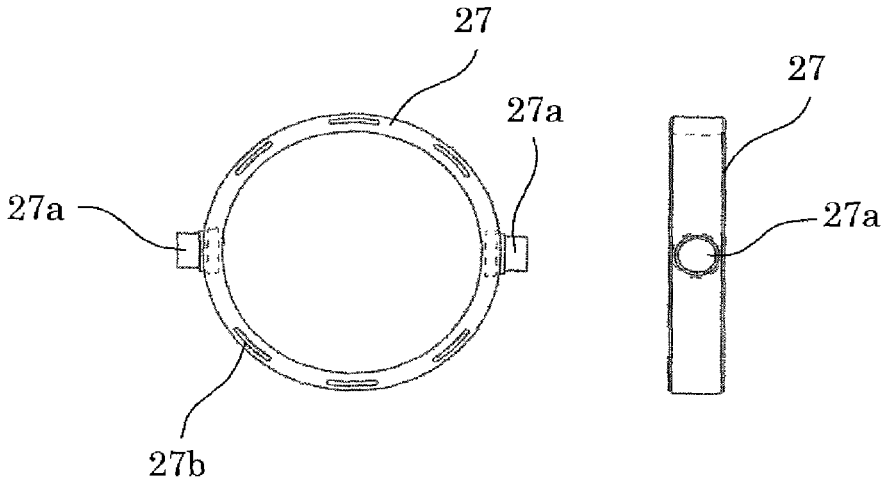
FIG. 4 is a view showing an annular plate in a starter according to Embodiment 2 of the present invention.

FIG. 4 is a view showing an annular plate in a starter according to Embodiment 2 of the present invention.

Description has been made on the case where the above described annular plate 24 and the convex shaped engaging portion 24*a* in Embodiment 1 are made of the resin member. However, in Embodiment 2 of the present invention, an annular portion of an annular plate 27 is made of a resin member as in Embodiment 1; but a convex shaped engaging portion 27*a* of the annular plate 27 is made of an iron member and is configured by being integrally formed with or by being press-fitted to the annular plate 27. Accordingly, the convex shaped engaging portion 27*a* of the annular plate 27 becomes the same material as an iron lever body 7*a* and a lever body 7*b*; and thus, abrasion resistance is further improved. Incidentally the annular plate 27 is formed with grooves 27*b* as in the above described Embodiment 1; and the groove 27*b* may be formed by a through hole.

Embodiment 3

Figure 5:
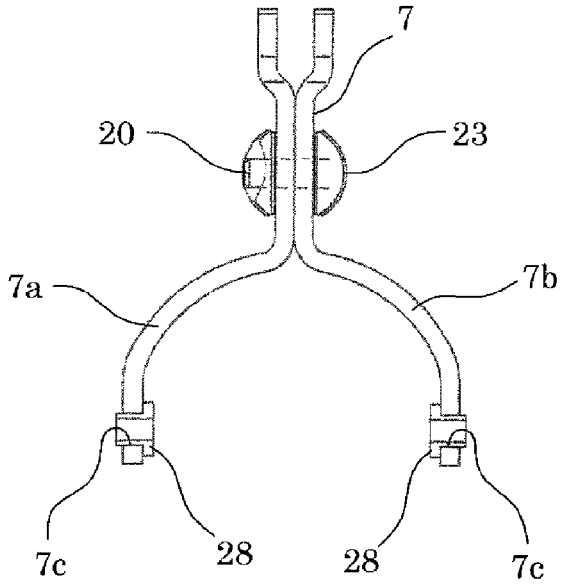
FIG. 5 is a front view showing a shift lever portion in a starter according to Embodiment 3 of the present invention.

FIG. 5 is a front view showing a shift lever portion in a starter according to Embodiment 3 of the present invention.

Embodiment 3 of the present invention is configured such that a bush 28 is disposed in a passing through hole 7*c* which is provided at each end portion on the other side of lever bodies 7*a* and 7*b* of a shift lever 7. The bush 28 is made of a resin member and is configured by being press-fitted to or by being integrally formed with each of the passing through holes 7*c* of the lever bodies 7*a* and 7*b*. Accordingly, the bush 28 is the same material as a resin annular plate 24 or annular plate 27; and thus, abrasion resistance is improved. Incidentally, the bush 28 has a through hole to which a convex shaped engaging portion 24*a* of the annular plate 24 or a convex shaped engaging portion 27*a* of the annular plate 27 is passed through.

Embodiment 4

Figure 6:
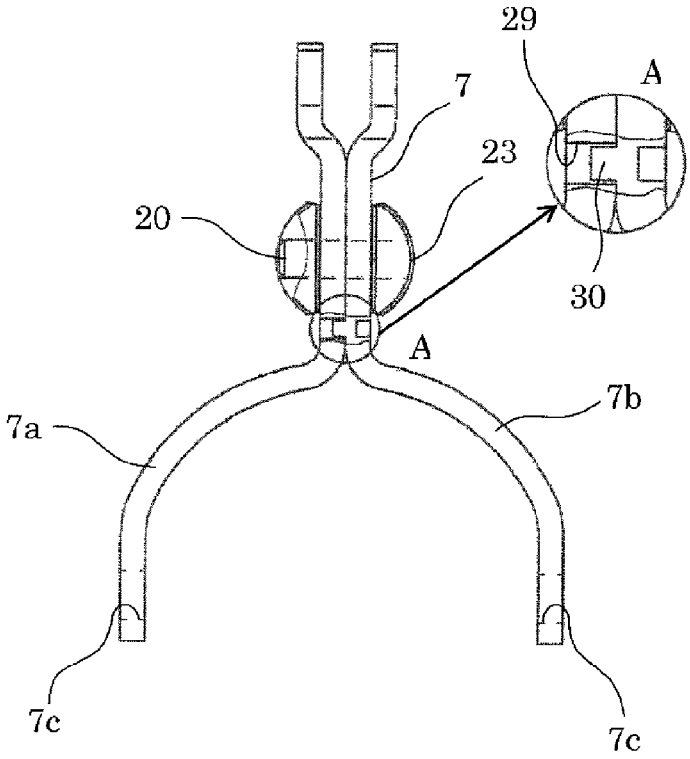
FIG. 6 is a front view showing a shift lever portion in a starter according to Embodiment 4 of the present invention.
Figure 7:
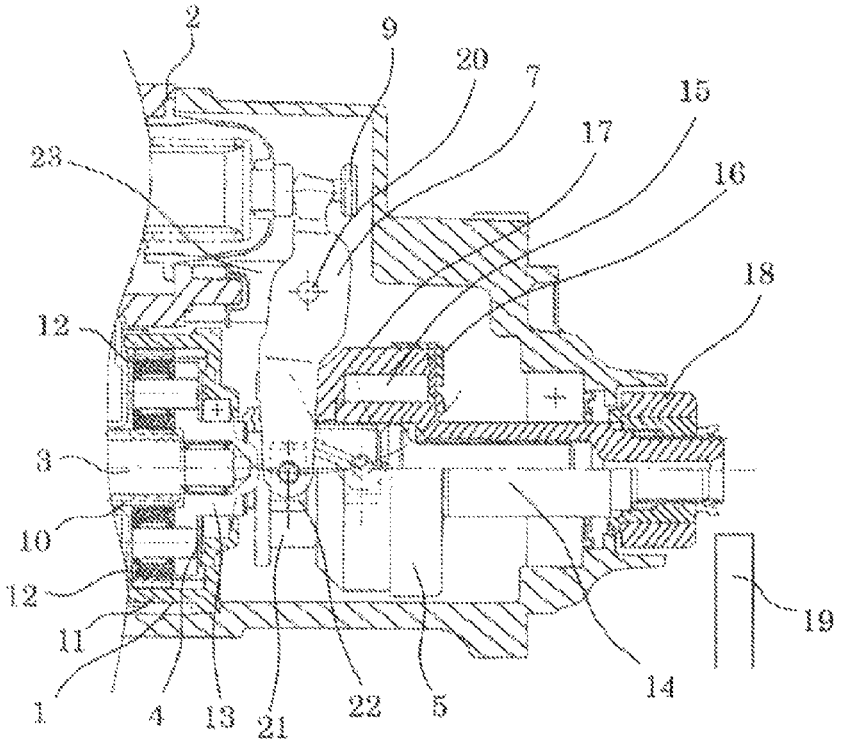
Fig. 7 PRIOR ART
FIG. 7 is a sectional view showing a conventional starter.
Figure 8:
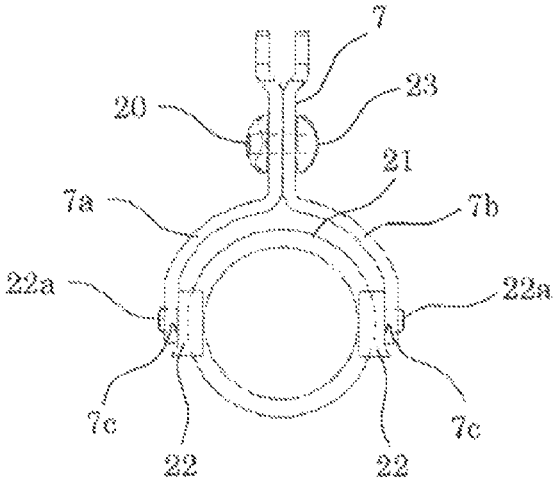
Fig. 8 PRIOR ART
FIG. 8 is a front view showing a shift lever portion in the conventional starter.

FIG. 6 is a front view showing a shift lever portion in a starter according to Embodiment 4 of the present invention.

In Embodiment 4 of the present invention, one of a pair of lever bodies 7*a* and 7*b* of a shift lever 7 is formed with a first engaging portion 29 and the other of the pair of lever bodies 7*a* and 7*b* is formed with a second latching portion 30 that is engaged with the first engaging portion 29.

As an example, the figure shows the case where, as shown in an enlarged portion "A" indicated by an arrow, the first engaging portion 29 is formed on the lever body 7*a* side and the first engaging portion 29 is formed to be a concave shaped portion configured by a through hole and the second engaging portion 30 is formed on the lever body 7*b* side; and the second latching portion 30 is formed to be a convex shaped portion which is engaged with the concave shaped portion configured by the through hole which constitutes the first engaging portion 29.

As described above, the second engaging portion 30 on the lever body 7*b* side is engaged with the first engaging portion 29 on the lever body 7*a* side; accordingly, the pair of lever bodies 7*a* and 7*b* of the shift lever 7 can be positioned, the pair of lever bodies 7*a* and the lever body 7*b* of the shift lever 7 are not misaligned during assembling to a holder 23 and during inserting of a fulcrum pin 20; and thus, assembling performance is improved.

It will be understood that that the engagement configuration of the first engaging portion 29 and the second engaging portion 30 in Embodiment 4 can be applied to the above described respective embodiments and the same effects can be exhibited. Furthermore, the present invention is not limited to the above described embodiments, for example, the present invention can also be applied to the above described conventional configuration, and the same effects can be exhibited in this case.

While the presently preferred embodiments of the present invention have been shown and described. It is to be understood that these disclosures are for the purpose of illustration and that various changes and modifications may be made without departing from the scope of the invention as set forth in the appended claims.

What is claimed is:

1. A starter comprising:

a motor;

an electromagnetic switch which switches energization to said motor;

a clutch which transmits rotational force from said motor to a ring gear via a pinion and is configured to be capable of reciprocating;

a shift lever which is configured by a pair of lever bodies that are arranged so that one side is engaged with a plunger coupled to said electromagnetic switch and the other side is engaged with said clutch by striding over said clutch and is branched as a two-pin fork and being formed with a passing through hole at each end portion on the other side of said lever bodies, and are driven by a movement of said plunger to reciprocate said clutch; and a holder which holds said pair of lever bodies of said shift lever;

wherein an annular plate is arranged at an engaging portion of said clutch and on the inside of the branched two-pin fork on the other side of said lever bodies of said shift lever, and has two convex shaped engaging portions which are passed through the passing through holes formed at each end portion on the other side of said lever bodies of said shift lever, while the holder holds the pair of lever bodies, such that a fulcrum pin is inserted into the holder to fix and assemble the pair of lever bodies to one another over the annular plate, wherein the two convex shaped engaging portions are formed integrally with the annular plate, and said annular plate is made of a resin member.

2. The starter according to claim 1, wherein said annular plate is formed with a groove or a through hole.

3. The starter according to claim 1, wherein said annular plate is configured to be the same shape in shapes of the top and bottom and front and back.

4. The starter according to claim 1, wherein the passing through hole formed at each end portion on the other side of said lever bodies of said shift lever is provided with a bush.

5. The starter according to claim 4, wherein said bush is made of a resin member.

6. The starter according to claim 1, wherein said convex shaped engaging portion comprises an iron member.

7. The starter according to claim 6, wherein the passing through hole formed at each end portion on the other side of said lever bodies of said shift lever is provided with a bush.

8. The starter according to claim 7, wherein said bush is made of a resin member.

9. The starter according to claim 6, wherein said annular plate is formed with a groove or a through hole.

10. The starter according to claim 6, wherein said annular plate is configured to be the same shape in shapes of the top and bottom and front and back.

11. The starter according to claim 1, wherein each respective convex shaped engaging portion is configured to protrude through the corresponding passing through hole in an outward direction from the annular plate.

12. The starter according to claim 1, wherein each respective convex shaped engaging portion is configured to protrude as one piece through the corresponding passing through hole.

13. The starter according to claim 1, wherein the lever bodies are formed of metal.

* * * * *